United States Patent [19]

Kohno et al.

[11] Patent Number: 4,957,664

[45] Date of Patent: Sep. 18, 1990

[54] APPARATUS FOR INJECTING AN ACCELERATING FUEL

[75] Inventors: Yoshihiro Kohno, Hamakita; Kazumi Iida, Iwata, both of Japan

[73] Assignees: Yamaha Hatsudoki Kabushiki Kaisha; Sanshin Kogyo Kabushiki Kaisha, Iwata, Japan

[21] Appl. No.: 679,605

[22] Filed: Dec. 7, 1984

Related U.S. Application Data

[63] Continuation of Ser. No. 460,767, Jan. 25, 1983, abandoned.

[30] Foreign Application Priority Data

Jan. 26, 1982 [JP] Japan ..... 57-9584

[51] Int. Cl.[5] ..... F02M 7/08

[52] U.S. Cl. ..... 261/34.2; 261/18.3

[58] Field of Search ..... 261/34.2, 18.3

[56] References Cited

U.S. PATENT DOCUMENTS

| | | | |
|---|---|---|---|
| 1,414,035 | 4/1922 | Mayer | 261/34 A |
| 2,183,636 | 12/1939 | Berry | 261/34 A |
| 2,635,625 | 4/1953 | Moseley et al. | 261/34 A |
| 2,915,303 | 12/1959 | Winkler | 261/34 A |
| 4,025,588 | 5/1977 | Nakamura et al. | 261/34 A |
| 4,045,521 | 8/1977 | Lemonnier et al. | 261/41 R |
| 4,251,471 | 2/1981 | Schwander et al. | 261/34 A |
| 4,387,676 | 6/1983 | Couceiro | 261/34 A |
| 4,390,480 | 6/1983 | Noisier | 261/34 A |
| 4,440,697 | 4/1984 | Sakurai | 261/34 A |

*Primary Examiner*—Tim Miles

*Attorney, Agent, or Firm*—Ernest A. Beutler

[57] ABSTRACT

Several embodiments of accelerating fuel systems and methods for delivering accelerating fuel to an internal combustion engine over an extended time period. In each embodiment, the accelerating pump delivers a portion of its discharge fuel to a storage chamber and the storage chamber redelivers the fuel to the engine after the completion of the pumping stroke of the accelerating pump. In some embodiments of the invention, the stored fuel is returned to the engine by gravity. In some embodiments, the stored fuel is delivered to the engine at a different rate than the rate at which it is stored. In some embodiments, the return rate is dependent upon the change of speed of the engine and in other embodiments, the return rate is responsive to the acceleration of the vehicle powered to the engine.

4 Claims, 3 Drawing Sheets

APPARATUS FOR INJECTING AN ACCELERATING FUEL

This application is a continuation of application Ser. No. 460,767, filed Jan. 25, 1983, now abandoned.

BACKGROUND OF THE INVENTION

This invention relates to an apparatus for injecting an accelerating fuel and more particularly to an improved acceleration fuel delivery system and method for the induction system of an internal combustion engine.

As is well known, it is desirable to provide some form of accelerating fuel delivery system for an engine for delivering extra fuel under acceleration conditions, when the engine throttle is rapidly opened. Because of the greater weight of the fuel, the mixture strength tends to lean during rapid opening of the throttle valves. That is, the less dense air can accelerate more rapidly than the heavier density fuel and unless additional fuel is provided, a lean mixture and poor acceleration will result. For this reason, it is a common practice to provide an accelerating pump that is operated in response to opening movement of the throttle valves so as to inject additional fuel into the induction air stream.

Although such acceleration pump arrangements aid in improving performance under acceleration, conventional accelerating pumps do not fully supply the needs of the engine during acceleration. That is, because the accelerating pump is responsive to the movement of the throttle valve rather than the actual demand of the engine, conventional accelerating pumps tend to inject excess fuel at the initiation of the acceleration mode and insufficient fuel at the end of the acceleration rode. Furthermore, the opening of the throttle valve under acceleration conditions does not truly represent the actual change in engine speed and/or the actual change in performance of the associated vehicle. That is, even though the throttle valves may be opened rapidly, the engine speed and the speed of the associated vehicle accelerate less rapidly. Therefore, the conventional type of acccelerating pump generally supplies more fuel than is necessary at the initiation of the acceleration mode and less fuel than is required at the end of the acceleration period.

It has been proposed, therefore, to incorporate an accelerating pump in which a spring is interposed between the throttle actuated member and the pumping member of the accelerating pump. With such an arrangement, the spring is loaded during initial opening of the throttle valve and the accelerating pump pumping member is operated with a delayed action. Such an arrangement tends to reduce the amount of fuel delivery during initial throttle opening and have the fuel delivery delayed for a period of time. Although such an arrangement appears to be feasible, in practice it does not solve the problems as aforenoted. Furthermore, it is extremely difficult to provide an accurate calibration for the spring and relate the movement of the accelerating pump pumping member to the throttle valve when a spring is interposed between these members. As a result, poor performance on acceleration can result.

It is, therefore, a principle object of this invention to provide an improved accelerating fuel delivery system for an internal combustion engine.

It is a further object of this invention to provide an accelerating pump in which the fuel delivery is more directly related to the actual requirements of the engine.

It is a further object of this invention to provide a improved method for delivering fuel to an engine during the acceleration mode.

It is a further object of this invention to provide an accelerating fuel delivery method that is directly related to the engine requirements.

SUMMARY OF THE INVENTION

A first feature of this invention is adapted to be embodied in an accelerating pump system for an internal combustion engine or the like that includes an accelerating pump, a storage chamber and means for delivering fuel to the storage chamber from the accelerating pump. Discharge means are incorporated for delivering fuel from the storage chamber to the associated engine.

Another feature of the invention is adapted to be embodied in an accelerating pump system for an internal combustion engine or the like that includes an accelerating pump having a pumping stroke. In accordance with this feature of the invention, means are provided for delivering fuel to the induction system after the pumping member completes its stroke.

Yet another feature of the invention is also adapted to be embodied in an accelerating pump system for an internal combustion engine or the like that includes an accelerating pump having an operative stroke. In accordance with this feature of the invention, means are provided for delivering fuel from the accelerating pump to the engine at a rate that is dependent upon a change in speed of the engine during the acceleration mode.

Still a further feature of the invention is adapted to be embodied in an accelerating pump system for an internal combustion engine or the like having an accelerating pump with an operative stroke. In accordance with this feature of the invention, the engine is used to power a vehicle and means deliver fuel from the accelerating pump to the engine at a rate that is dependent upon the rate of acceleration of the vehicle.

A further feature of this invention is adapted to be embodied in a method for delivering fuel from an accelerating pump to an internal combustion engine. In accordance with this feature of the invention, at least a portion of the fuel delivered during the operational stroke of the accelerating pump is stored and is delivered to the engine after the accelerating pump has completed its stroke.

A still further feature of the invention is also adapted to be embodied in a method for delivering accelerating fuel to an internal combustion engine. In accordance with this method, an accelerating pump is provided that has an operative stroke for delivering a quantity of fuel. When the accelerating pump is operated, a portion of the delivered fuel is stored and is delivered to the engine at a rate that is dependent upon its change of speed.

Another feature of the invention is adapted to be embodied in a method for delivering fuel to the internal combustion engine of an engine that powers a vehicle. An accelerating pump is provided that delivers a measured amount of fuel during a given pumping stroke. In accordance with this method, a portion of the delivered fuel is stored and is delivered to the engine at a rate that is dependent upon the rate of acceleration of the vehicle.

DETAILED DESCRIPTION OF THE PREFERRED EMBODIMENTS

Figure 1:
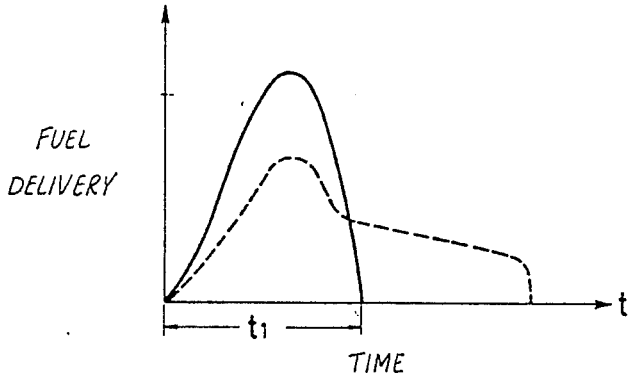
FIG. 1 is a graphical representation showing the theory of the invention and the operation of the embodiments in relation to a prior art construction.

The theory of the invention may be best understood by reference to FIG. 1. FIG. 1 is a graphical analysis showing the fuel delivery of accelerating fuel systems constructed in accordance with the prior art and in accordance with this invention. In FIG. 1, time is indicated on the abscissa and the amount of fuel delivery by the accelerating system is represented on the ordinate. The dimension $T_1$ represents the amount of time it takes for the pumping member of the accelerating pump to complete its stroke in relation to the opening of the throttle valve. In the illustrated prior art embodiment, a solid line curve represents the fuel delivery of an accelerating pump system wherein a spring is interposed between the throttle actuated member and the accelerating pump pumping member. It will be noted that as the throttle is opened, the spring initially is compressed and then the load on the spring is released. This results in a delivery curve in which the fuel initially lags the throttle movement and then rapidly is discharged to a peak and diminishes abruptly. Although some time delay in fuel delivery is accomplished with this type of prior art system, the time delay is insufficient to accommodate for the actual running conditions of the engine. The acceleration mode continues long after the pumping member has completed its stroke and, accordingly, there is insufficient accelerating fuel delivered during this additional time period. This results in poor performance. Also, excess fuel is delivered during the initial acceleration stage since the accelerating fuel is delivered at a substantially greater rate than the actual acceleration of the engine and associated vehicle warrants. As a result, poor fuel economy results during this mode.

An accelerating fuel delivery system operating in accordance with this invention is identified by the broken line curve in FIG. 1. In accordance with this invention, the amount of fuel delivered to the engine during the initial portion of the acceleration rode is reduced and the fuel delivered by the accelerating pump is stored for gradual delivery during the full acceleration mode. The rate of delivery can be dependent upon a number of factors such as time, actual change in engine speed, or rate of acceleration of the vehicle that is powered by the associated engine. In all events, it should be readily apparent from FIG. 1 that the fuel delivery time during the acceleration mode is significantly increased and the amount of fuel delivered during the initial acceleration mode is substantially reduced so as to improve fuel economy and overall performance.

Physical embodiments of the invention will now be described, first by reference to FIGS. 2 and 3 wherein a carburetor having an accelerating fuel system constructed with a first embodiment of the invention is identified generally by the reference numeral 11. In the described embodiments, the carburetor 11 is of the two-barrel, multi-fuel type. It is to be understood, however, that certain features of the invention can be used in conjunction with single fuel carburetors, carburetors having other than two barrels and in fact in conjunction with fuel injection systems or any other system for injecting accelerating fuel into the induction system of an internal combustion engine including the crankcase of a two cycle engine.

The carburetor 11 includes a main body portion 12 that is formed with a pair of induction passages 13. Throttle valves 14 are affixed to a throttle valve shaft 15 that extends across the carburetor body 12 for controlling the flow through the induction passages 13 in a known manner. A throttle controlling lever 16 is affixed to the exposed end of the throttle valve shaft 15 for connection to a suitable operator control so as to permit this operation of the throttle valves.

A main fuel bowl 17 is affixed to the main body portion 12 and has a float chamber that maintains a uniform head of main running fuel. In view of the multi-fuel nature of the carburetor 11, this main running fuel may comprise a relatively low grade fuel such as alcohol or kerosene. Fuel is delivered to the induction passages 13 from the main fuel bowl 17 through main fuel discharge nozzles 18 and associated fuel delivery circuits and also through transition fuel delivery circuits of any known type. Inasmuch as the main and transition fuel delivery circuits form no part of the invention, they have not been illustrated or described in detail.

An auxiliary body portion 19 is affixed to the rain body port in 12 in a known manner and carries an auxiliary fuel bowl 21. An auxiliary fuel such as gasoline is delivered in a known manner to the auxiliary fuel bowl 21 and is maintained in a uniform head in the auxiliary fuel bowl 21 by a float operated needle valve. The auxiliary fuel from the auxiliary fuel bowl 21 may be delivered to the induction passages 13 through suitable starting and idle circuits so as to provide a higher quality fuel to the induction passages 13 for these running conditions. In view of the fact that the starting and idle circuits form no part of the invention, these circuits have not been illustrated nor will they be described in detail. Those skilled in the art can readily understand suitable circuits for this purpose.

An accelerating pump, indicated generally by the reference numeral 22 is provided in the auxiliary body 19 for delivering the auxiliary fuel to the induction passages 13 under the acceleration mode. The accelerating pump 22 comprises a generally conventional pumping assembly consisting of a bore 23 in the auxiliary fuel bowl body 21 in which a pumping piston 24 is supported for reciprocation. A coil spring 25 is positioned in the bore 23 and engages the underside of the pumping piston 24 so as to urge the pumping piston 24 to its home position.

An accelerating pump rod 26 is affixed to the piston 24 and extends upwardly through the auxiliary body portion 19. A pump actuating lever 27 is affixed to an accelerating pump actuating shaft 28 which is, in turn, rotatably journalled in a known manner in the body portion 12. The pump lever 27 is adapted to engage the pump rod 26 under opening of the throttle valves 14 so as to urge the pump rod 26 and piston 24 downwardly during opening of the throttle valves. The accelerating pump operating shaft 28 is coupled to the throttle valve lever 16 for operation with it by means of a known accelerating pump linkage, indicated generally by the reference numeral 29.

Auxiliary fuel is delivered to the accelerating pump bore 23 from the auxiliary fuel bowl 21 by means including a delivery check valve 31. The fuel is delivered from the bore 23 through a passage 32 that is formed in the auxiliary fuel bowl 21 and which terminates at a delivery check valve assembly 33 that is carried at the upper end of this passage by the auxiliary body member 19. The delivery check valve 33 serves a delivery passage 34 formed in the auxiliary body 19. An accelerating pump discharge tube 35 extends through a bore in the main body portion 12 across one of the induction passages 13 and into the other of these induction passages. The accelerating pump delivery tube 35 has its inlet end in communication with the accelerating pump discharge passage 34 of the auxiliary body portion 19. A pair of downstream facing accelerating pump discharge ports 36 are formed in the delivery tube 35 and discharge into the induction passages 13 at approximately their centers and substantially upstream of the venturi section of the induction passages 13.

In accordance with the invention, a storage chamber 37 is carried by or a part of the main body portion 12 and is interposed between the induction passages 13. The storage chamber 37 communicates with the interior of the accelerating pump delivery tube 35 by means of an opening 38 which is generally larger in size than the accelerating pump discharge ports 36.

In operation, during cold starting and idle operation, gasoline is fed to the induction passages 13 from the auxiliary fuel bowl 21 through conventional cold starting and idle circuits. As the throttle valves 14 are progressively opened, the main transition and eventually the fuel delivery system from the fuel in the main fuel bowl 17 will gradually begin to flow and kerosene will be delivered to the induction passages 13. If desired, an arrangement may be incorporated for cutting off the flow of gasoline from the idle circuits once the main fuel discharge circuits begin to operate.

When the throttle valves 14 are rapidly opened by rotation of the throttle valve shaft 15, the accelerating pump rod 26 will be driven downwardly by the accelerating pump operating lever 27. This causes the check valve 31 to close and fuel will be driven from the bore 23 by the downward movement of the piston 24 through the delivery passage 32, check valve 33 and passage 34. Sore of this fuel will be injected into the induction passages 13 from the accelerating tube delivery ports 36. However, these ports are relatively restricted in size and a quantity of the fuel delivered by the accelerating pump 32 will pass into the storage tank 37 through the substantially unrestricted opening 38. Hence, during the pumping stroke of the accelerating pump piston 24, only a portion of the fuel is delivered through the accelerating pump discharge ports 36, the remaining fuel being delivered to the storage chamber 37.

Even though the throttle valves 14 have been opened, the engine will continue to accelerate. Additional acceleration fuel will be delivered during this rode by gravity from the storage tank 37. The fuel will then flow downwardly through the passage 38 into the accelerating pump delivery tube 35 for discharge through the accelerating ports 36. Thus, additional fuel will be delivered during the remainder of the acceleration mode and improved acceleration during this condition will be obtained. The time during which the additional fuel is delivered can be varied by appropriately sizing the opening 38 and the ports 36.

It should be readily apparent that the described embodiment permits smooth acceleration even if kerosene is used as a main fuel because the more highly volatile gasoline delivered by the accelerating pump can be delivered for a longer period of time during the accelerating mode than with the prior art type of arrangements.

Figure 2:
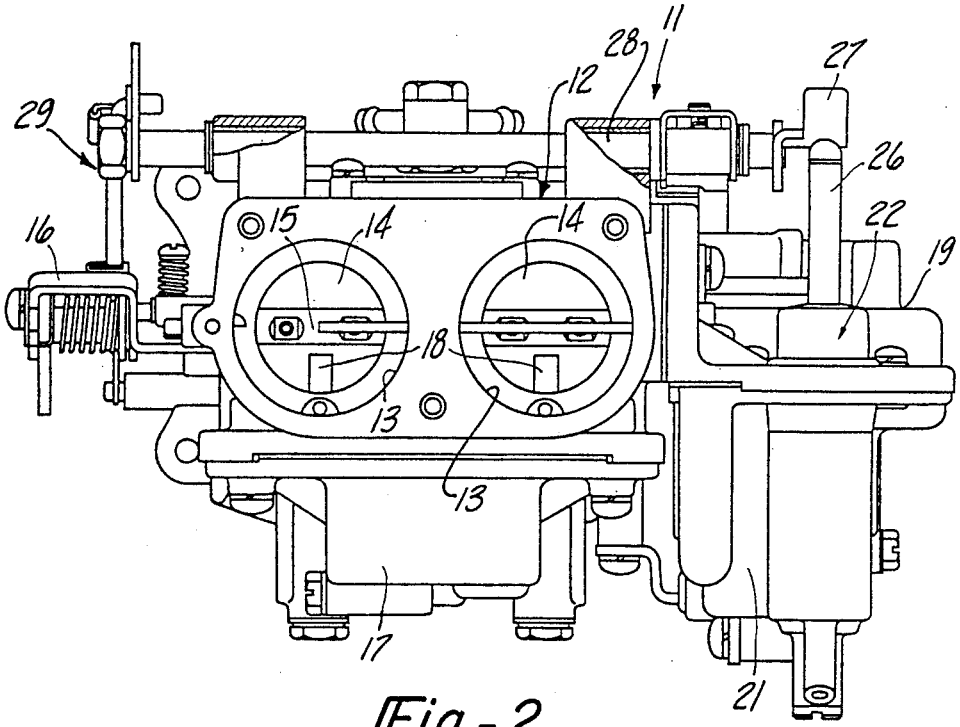
FIG. 2 is an end elevational view, with portions broken away, of a carburetor constructed in accordance with an embodiment of the invention.
Figure 3:
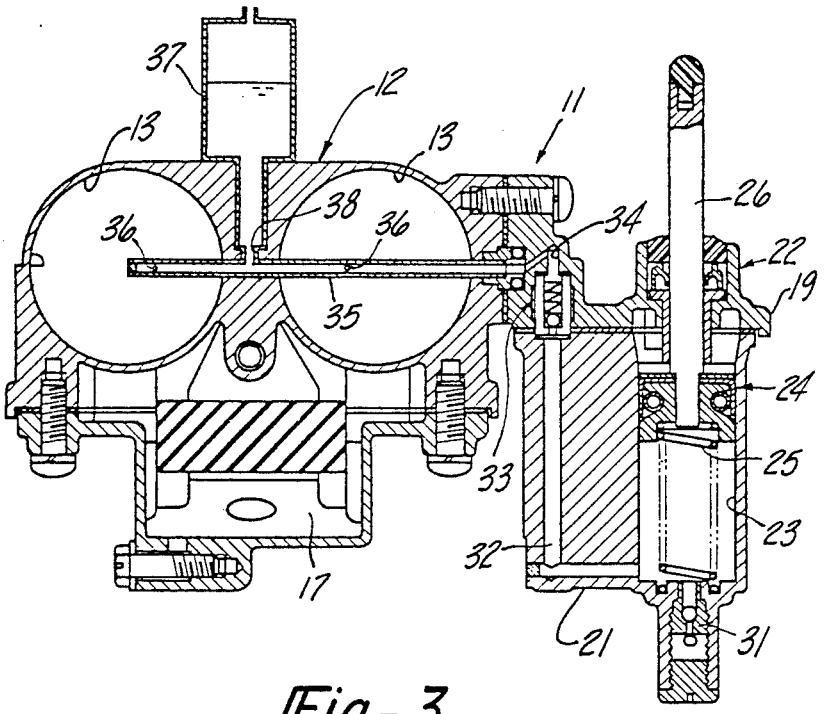
FIG. 3 is a cross-sectional view taken through the accelerating system of the carburetor of FIG. 2.
Figure 4:
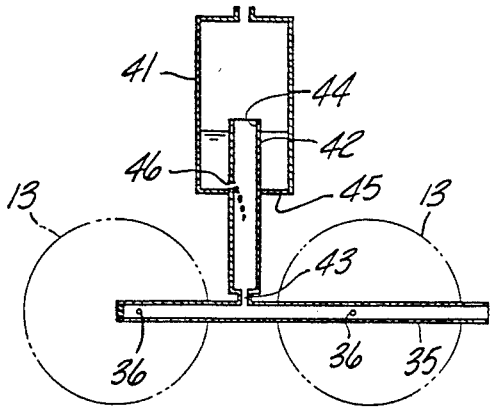
FIG. 4 is a schematic view showing another embodiment of the invention.

In the embodiments of FIGS. 2 and 3, the delivery of auxiliary fuel to the storge tank 37 and return of the fuel from this storage tank 37 back to the accelerating system was controlled primarily by a single opening 38. Hence, the rates of delivery and discharge from the storage chamber 37 are controlled by this single opening. FIG. 4 illustrates an embodiment of the invention wherein substantially unrestricted charging of the storage chamber is permitted and a restricted flow of fuel from the storage chamber back to the accelerating system may be enjoyed. As a result, the time of accelerating fuel discharge can be further lengthened.

Referring now specifically to FIG. 4, only the accelerating delivery tube 35 and the storage chamber portion of the accelerating system of this embodiment have been illustrated. The remaining components have been shown either in phantom or completely eliminated. Except for the components which will be illustrated and described, it is to be understood that the remaining components of the carburetor of this embodiment are the same as the embodiment of FIGS. 2 and 3.

In accordance with this embodiment of the invention, a storage chamber 41 is positioned either internally of the carburetor body portion 12 or is supported by it above the induction passages 13. A stand pipe 42 communicates at its lower end with the interior of the accelerating pump delivery tube 35 by means of an opening 43. The stand pipe 42 extends so that its open upper end 44 is positioned a substantial distance above the bottom wall 45 of the storage chamber 41. Preferably, the open upper end 44 is disposed at a higher level than the maximum amount of fuel which is expected to be stored in the storage chamber 41.

Adjacent the lower wall 45, the stand pipe 42 is provided with a restricted opening 46 that extends through its side wall. The opening 46 is smaller than the opening 43 and is sized so as to control the rate of fuel redelivery from the storage chamber 41 back to the accelerating tube 35 in a manner now to be described.

This embodiment operates as follows. When the accelerating pump 22 operates during its pumping cycle, fuel will again be delivered to the induction passages 13 through the accelerating pump discharge ports 36. A quantity of fuel will, however, be delivered to the storage chamber 41 at a substantially unrestricted rate through the opening 43 and stand pipe 42. Once the accelerating pump has completed its pumping cycle, fuel from the storage chamber 41 will be returned to the accelerating pump tube 35 for delivery to the induction passages 13 from the accelerating pump discharge ports 36. The size of the opening 46 will determine the rate of redelivery and, accordingly, the tire during which the accelerating fuel discharge system continues to operate.

Figure 5:
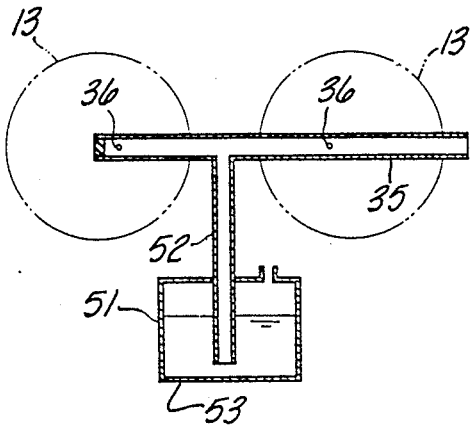
FIG. 5 is a schematic view showing a still further embodiment of the invention.

In the embodiments of FIGS. 2 and 3 and of FIG. 4, the time of fuel delivery from the storage chambers 37 and 41 has been determined by a size of the orifice. Therefore, the amount of redelivery is generally related only to time and is relatively independent of actual running conditions of the engine. FIG. 5 illustrates an embodiment of the invention wherein the rate of fuel redelivery will be determined by the actual change in speed of the engine.

Referring now specifically to this embodiment, it differs from the previously described embodiments only in the location and method of charging and delivering fuel from the storage chamber. Therefore, only this portion of the carburetor has been illustrated and will be described in detail.

In accordance with this embodiment, a storage chamber 51 is provided that is disposed at a level lower than that of the induction passages 13. A delivery tube 52 extends from the accelerating pump delivery tube 35 downwardly into the storage chamber 51 and terminates adjacent its lower wall 53. In accordance with this embodiment, the entry to the delivery tube 52 can be substantially unrestricted and the amount of fuel delivered to the storage chamber 51 will be dependent primarily upon the size of the accelerating pump discharge ports 36.

As with the previously described embodiments, initial opening of the throttle valves and operation of the accelerating pump 22 will cause some accelerating fuel to be delivered through the accelerating pump delivery ports 36. However, the excess fuel will be transferred to the storage chamber 51 through the delivery tube 52. Once the accelerating pump has completed its pumping stroke, fuel can be drawn from the storage chamber 51 through the tube 52, accelerating pump tube 35 and accelerating pump discharge ports 36. The rate of fuel redelivery will depend upon the vacuum existing at the ports 36 which will, in turn, be dependent at upon the actual speed and air flow delivered to the engine. Hence, with this embodiment, the rate of fuel redelivery will be dependent upon actual changes in engine speed and can continue during a substantial portion or the entirety of the accelerating mode.

Figure 6:
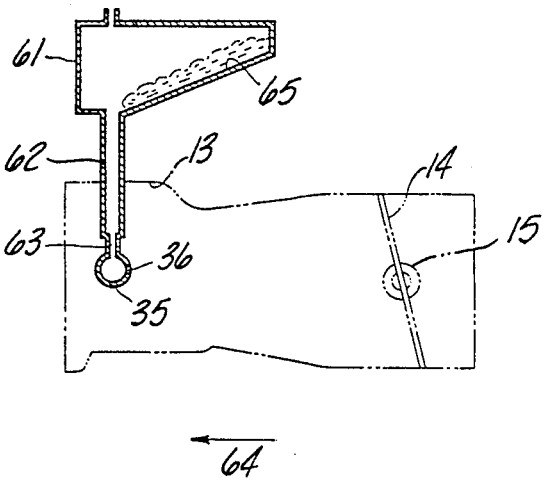
FIG. 6 is an additional schematic view showing an additional embodiment of the invention.

FIG. 6 illustrates an embodiment of the invention wherein the amount of fuel redelivery is dependent upon the acceleration of the vehicle powered by the engine associated with the carburetor 11. In all of the embodiments described, the invention is particularly adapted for utility in conjunction with outboard rotors for marine application. However, it is to be understood that such application is merely exemplary and that the invention may be used in a wide variety of applications. The embodiment of FIG. 6 is particularly adapted for use when the engine is associated with a vehicle such as a boat.

In accordance with this embodiment of the invention, a storage tank 61 is positioned at a level above the induction passages 13. The storage tank 61 communicates with the accelerating pump delivery tube 35 by means of a delivery tube 62 and restricted opening 63 that will determine the rate of fuel delivery to the storage tank 61. The carburetor 11 is associated with a vehicle such as a boat that normally travels in the direction of the arrow 64. Hence, in accordance with this embodiment of the invention, the storage chamber 61 has a lower wall 65 that is inclined upwardly in the direction opposite to that of the direction of travel. When applied to a boat, this means that the wall 65 is inclined upwardly toward the rear of the boat.

During acceleration, the accelerating pump will deliver fuel to the induction passages 13 through the accelerating pump delivery tube 35 and ports 36 as aforedescribed. In addition, an amount of fuel will also be delivered to the storage chamber 61 through the opening 63 and delivery tube 62. Once the accelerating pump has completed its stroke, this fuel will be redelivered from the storage tank 61 and delivery tube 62 back to the accelerating pump delivery tube 35 for delivery to the induction passages 13 through the ports 36. The amount of fuel redelivery will be determined by the rate of acceleration of the associated vehicle. If the vehicle accelerates rapidly, fuel will be drawn to the rear of the wall 65 as shown in the phantom lines and its redelivery will be restricted. Thus, if the boat has accelerated rapidly, the redelivery time will be stretched over a greater period of time so that fuel will not be wasted. If, however, acceleration is slow, the fuel redelivery rate will be greater until the acceleration reaches that indicative that the engine is again operating at full potential.

It should be readily apparent that a number of embodiments of the invention have been described each of which provides for good operation during the acceleration mode without the wastage of fuel by excess delivery during the initial stages and by extending the amount of fuel delivery for a time considerably longer than the time during which the accelerating pump operates through its pumping cycle. Arrangements have been also described that tailor the redelivery rate to actual changes in engine speed or acceleration of the associated vehicle. Although the invention has been described and all embodiments in conjunction with multi-fuel carburetors, it is to be understood that it can be used in conjunction with single fuel carburetors. Furthermore, the invention can be used in conjunction with other types of charge forming devices than carburetors such as with fuel injection. As has been aforedescribed, the invention can also be used with two cycle engines wherein the accelerating pump discharges directly into the crankcase of the engine. Although a number of embodiments have been described and illustration, various other changes and modifications may be made without departing from the spirit and scope of the invention, as defined by the appended claims.

We claim:

1. An accelerating pump system for an internal combustion engine or the like comprising an accelerating pump, a storage chamber, means for delivering fuel to said storage chamber from said accelerating pump comprising a pipe extending into said storage chamber and being open at its upper end into said storage chamber, and discharge means for delivering fuel from said storage chamber to the associated engine comprising a restricted orifice positioned in the pipe contiguous to the lowermost wall of the storage chamber, said means for delivering the fuel to said storage chamber delivers the fuel at a different rate than said discharge means delivers fuel from said storage chamber.

2. An accelerating pump system for an internal combustion engine or the like comprising an accelerating pump, a storage chamber, means for delivering fuel to said storage chamber from said accelerating pump, and discharge means for delivering fuel from said storage chamber to the associated engine, said means for delivering the fuel to said storage chamber delivers the fuel at a different rate than said discharge means delivers fuel from the storage chamber, said discharge means delivers fuel in relation to the rate of acceleration of a vehicle powered by the associated internal combustion engine, said storage chamber having an inclined lower wall extending upwardly in a direction opposite to that traveled by the associated vehicle and said discharge means comprises a pipe extending from a lower portion of said lowermost wall.

3. An accelerating pump system for an internal combustion engine or the like comprising an accelerating pump, an accelerating pump discharge nozzle, a fixed volume storage chamber, means for delivering fuel to said accelerating pump discharge nozzle and said storage chamber from said accelerating pump, said means for delivering the fuel to said storage chamber comprising a pipe extending into said storage chamber and being open at its upper end into the storage chamber, said accelerating pump being operative to deliver sufficient fuel during its pump stroke to cause fuel to accumulate in said storage chamber during its pumping stroke in addition to discharging fuel from said discharge nozzle and discharge means for delivering fuel from said storage chamber through the discharge nozzle to the associated engine, said discharge means including a restricted orifice positioned in said pipe contiguous to the lowermost wall of said storage chamber.

4. An accelerating pump system for a charge forming device for an internal combustion engine, said charge forming device comprising an induction passage having a venturi section, an accelerating pump, an accelerating pump discharge nozzle discharging into said induction passage upstream of said venturi section a substantial distance with the discharge therefrom being substantially independent of the vacuum at said venturi section, a fixed volume storage chamber, means for delivery fuel to said accelerating pump discharge nozzle and "said storage chamber from said accelerating pump, said accelerating pump being operative to deliver sufficient fuel during its pump stroke to cause fuel to accumulate in said storage chamber during its pumping stroke in addition to discharging fuel from said discharge nozzle and discharge means for delivering fuel from said storage chamber through the discharge nozzle to the associated engine, said storage chamber having an inclined lower wall extending upwardly in a direction opposite to that traveled by an associated vehicle powered by an internal combustion engine supplied with a full air mixture supplied by said charge form device and the discharge means comprises a pipe extending form a lower portion of the lowermost wall whereby said discharge means delivers fuel in relation to the rate of acceleration of the vehicle.

* * * * *